US010019873B2

(12) United States Patent
Okuaki et al.

(10) Patent No.: US 10,019,873 B2
(45) Date of Patent: Jul. 10, 2018

(54) GAME MACHINE, GAME CONTROL METHOD, AND COMPUTER PROGRAM

(75) Inventors: Masato Okuaki, Zama (JP); Tomoaki Hirai, Zama (JP); Toru Omoto, Zama (JP)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

(21) Appl. No.: 14/423,680

(22) PCT Filed: Aug. 31, 2012

(86) PCT No.: PCT/US2012/053428

§ 371 (c)(1),
(2), (4) Date: Jul. 16, 2015

(87) PCT Pub. No.: WO2014/035417

PCT Pub. Date: Mar. 6, 2014

(65) Prior Publication Data

US 2015/0317865 A1 Nov. 5, 2015

(51) Int. Cl.
*G07F 17/32* (2006.01)
*G07F 17/34* (2006.01)

(52) U.S. Cl.
CPC ..... *G07F 17/329* (2013.01); *G07F 17/3211* (2013.01); *G07F 17/3213* (2013.01); *G07F 17/3272* (2013.01); *G07F 17/34* (2013.01)

(58) Field of Classification Search
CPC ..... G07F 17/3213
See application file for complete search history.

(56) References Cited

U.S. PATENT DOCUMENTS 4,239,223 A 12/1980 Wilson
4,508,345 A * 4/1985 Okada ..... G07F 17/3227 273/143 R
4,822,048 A 4/1989 Axup
(Continued)

FOREIGN PATENT DOCUMENTS

EP 2 538 395 A1 12/2012
JP S63124274 A 5/1988
(Continued)

OTHER PUBLICATIONS

Notice of Reasons for Rejection with English Translation (JP 2015-529771): Dispatched: Mar. 8, 2016.
(Continued)

*Primary Examiner* — Steven J Hylinski
(74) *Attorney, Agent, or Firm* — Howard & Howard Attorneys PLLC

(57) ABSTRACT

A game machine is provided with a center unit which holds a lottery to select at least one option from a plurality of options by a relative movement between a roulette ring having a plurality of pockets corresponding respectively to the plurality of options and a ball and a center monitor which makes predetermined effects to a lottery in the center unit. The game machine controls the center monitor so as to make the effects when a temporal condition which is a lapse of a predetermined time after the lottery is started and a positional condition under which a JP pocket corresponding to a specific option among the plurality of options and the ball are in a predetermined positional relationship are satisfied.

14 Claims, 6 Drawing Sheets

(56) References Cited

U.S. PATENT DOCUMENTS

| | | | | |
|---|---|---|---|---|
| 4,984,796 | A | 1/1991 | Peacock | |
| 5,316,309 | A | 5/1994 | Takeshi | |
| 5,827,119 | A | 10/1998 | Bromley | |
| 5,845,903 | A * | 12/1998 | Sloan | A63F 7/048 273/108 |
| 6,164,647 | A | 12/2000 | Chee | |
| 6,217,022 | B1 | 4/2001 | Astaneha | |
| 6,227,542 | B1 | 5/2001 | Cosmi | |
| 6,902,479 | B1 * | 6/2005 | D'Avanzo | G07C 15/001 273/138.1 |
| 7,083,168 | B2 * | 8/2006 | Seelig | G07F 17/32 273/138.2 |
| 7,278,635 | B2 * | 10/2007 | Kelly | A63F 7/0058 273/118 A |
| 7,549,637 | B2 | 6/2009 | Lease | |
| 7,762,883 | B2 | 7/2010 | Griswold et al. | |
| 8,348,277 | B2 | 1/2013 | Fitoussi et al. | |
| 9,704,334 | B2 | 7/2017 | Inoue et al. | |
| 2002/0037765 | A1 * | 3/2002 | Johnson | G07F 17/32 463/17 |
| 2003/0073479 | A1 * | 4/2003 | Wilson | G07F 17/3213 463/16 |
| 2005/0014550 | A1 | 1/2005 | Rhoten | |
| 2005/0026673 | A1 | 2/2005 | Paulsen et al. | |
| 2005/0288089 | A1 | 12/2005 | Cammegh et al. | |
| 2006/0009278 | A1 * | 1/2006 | Vancura | G07F 17/3244 463/25 |
| 2006/0030394 | A1 * | 2/2006 | Crivelli | G07F 17/32 463/17 |
| 2006/0033268 | A1 | 2/2006 | Wong | |
| 2006/0046837 | A1 | 3/2006 | Ito et al. | |
| 2007/0265056 | A1 | 11/2007 | Yoshizawa | |
| 2009/0005149 | A1 | 1/2009 | Okuaki et al. | |
| 2009/0011826 | A1 * | 1/2009 | Acres | G07F 17/32 463/27 |
| 2009/0137303 | A1 * | 5/2009 | Halliburton | G07F 17/3295 463/17 |
| 2009/0176548 | A1 | 7/2009 | Nakamura et al. | |
| 2010/0102507 | A1 | 4/2010 | Bontempo et al. | |
| 2010/0109237 | A1 | 5/2010 | Cammegh et al. | |
| 2010/0120488 | A1 * | 5/2010 | Savytskyy | G07F 17/32 463/17 |
| 2010/0167804 | A1 | 7/2010 | Okuaki et al. | |
| 2011/0118013 | A1 | 5/2011 | Mattice et al. | |
| 2011/0180990 | A1 | 7/2011 | Fitoussi et al. | |
| 2011/0201411 | A1 * | 8/2011 | Lesley | G07F 17/32 463/25 |
| 2011/0281631 | A1 | 11/2011 | Bontempo et al. | |
| 2012/0034967 | A1 * | 2/2012 | Owen | G07F 17/3211 463/20 |
| 2013/0154186 | A1 | 6/2013 | Kang | |
| 2014/0187306 | A1 | 7/2014 | Nordahl et al. | |

FOREIGN PATENT DOCUMENTS

| | | | |
|---|---|---|---|
| JP | 2007-215783 | A | 8/2007 |
| JP | 2010119679 | A | 6/2010 |
| JP | 2011239966 | A | 12/2011 |
| JP | 2012100874 | A | 5/2012 |
| JP | 6081595 | B2 | 2/2017 |
| WO | 2010/058708 | A1 | 5/2010 |
| WO | 2010/058712 | A1 | 5/2010 |
| WO | 2010058711 | A1 | 5/2010 |
| WO | 2011/145376 | A1 | 11/2011 |

OTHER PUBLICATIONS

International Search Report and The Written Opinion (PCT/US2012/053428); dated Nov. 20, 2012.

Notice of Reasons for Rejection (JP Patent Application No. 2017-006684): Dispatch Date: Feb. 27, 2018.

Notice of Reasons for Rejection (JP Patent Application No. 2017-006687); Dispatch Date: Apr. 3, 2018.

Notice of Reasons for Rejection (JP Patent Application No. 2017-016963); Dispatch Date: Apr. 3, 2018.

Non-Final Office Action (U.S. Appl. No. 15/611,258); dated Mar. 19, 2018.

* cited by examiner

| | |
|---|---|
| TEMPORAL CONDITION<br>POSITIONAL CONDITION | THE ROULETTE GAME CONTROL PORTION EXECUTES THE BOOSTING EFFECT PROCESSING WHEN EACH CONDITION IS SATISFIED. |

GAME MACHINE, GAME CONTROL METHOD, AND COMPUTER PROGRAM

CROSS REFERENCE TO RELATED APPLICATION

This application is a national stage application of PCT/US2012/053428, filed Aug. 31, 2012, the disclosure of which is hereby incorporated by reference in its entirety.

TECHNICAL FIELD

The present invention relates to a game machine and the like including a lottery mechanism which holds a lottery to select at least one option from a plurality of options by a relative movement between a game board and a lottery object.

BACKGROUND ART

A game machine provided with a lottery mechanism is known (for example, see Patent Literature 1). When the game machine is, for example, a physical lottery mechanism of a roulette type, a ball enters any one of a plurality of lottery holes formed on a game board as a plurality of options, thereby being paid payout corresponding to the lottery hole into which the ball enters to the player.

Patent Literature 1: Japanese Patent No. 4331173.

SUMMARY OF INVENTION

Technical Problem

If there is a valuable option that has to be paid attention by a player or that a player is looking at such as an option of large payout and the like in a plurality of options, control of effect for making a player realize that the option is in a easily selected situation or a period of time and attracting a player's attention is required.

Therefore, the present invention aims to a game machine and the like capable of effects for attracting players in accordance with a relative movement between the game board and the lottery object.

Solution to Problem

The game machine of the present invention is a game machine including a lottery mechanism which holds a lottery to select at least one option from a plurality of options by a relative movement between a lottery board having a plurality of lots corresponding respectively to the plurality of options and a lottery object, wherein an effect device which makes predetermined effects to a lottery in the lottery mechanism and an effect control device which controls the effect device so as to make the effects when a temporal condition which is a lapse of a predetermined time after the lottery is started and a positional condition under which a specific lot corresponding to the specific option among the plurality of options and the lottery object are in a predetermined positional relationship are satisfied.

The game control method of the present invention is a game control method of a game machine comprising: a lottery mechanism which holds a lottery to select at least one option from a plurality of options by a relative movement between a lottery board having a plurality of lots corresponding respectively to the plurality of options and a lottery object; and an effect device which makes predetermined effects to a lottery in the lottery mechanism, wherein an effect control step which controls the effect device so as to make the effects when a temporal condition which is a lapse of a predetermined time after the lottery is started and a positional condition under which a specific lot corresponding to the specific option among the plurality of options and the lottery object are in a predetermined positional relationship are satisfied.

The computer program of the present invention is a computer program for a game machine comprising: a lottery mechanism which holds a lottery to select at least one option from a plurality of options by a relative movement between a lottery board having a plurality of lots corresponding respectively to the plurality of options and a lottery object; and an effect device which makes predetermined effects to a lottery in the lottery mechanism; wherein the computer program is constructed so as to the computer set in the game machine to serve as: an effect control device which controls the effect device so as to make the effects when a temporal condition which is a lapse of a predetermined time after the lottery is started and a positional condition under which a specific lot corresponding to the specific option among the plurality of options and the lottery object are in a predetermined positional relationship are satisfied.

According to the present invention, when temporal and positional conditions are satisfied in the lottery mechanism, the effect is executed by the effect device. For instance, by making the effect which makes a player realize that the specific lot becomes easy to be selected by the lottery, it is possible to attract the players to the game. Since such effects are executed when those conditions are satisfied while the lottery is executed, it is possible to effectively attract the players by controlling the period for the effects.

DESCRIPTION OF EMBODIMENTS

Figure 1:
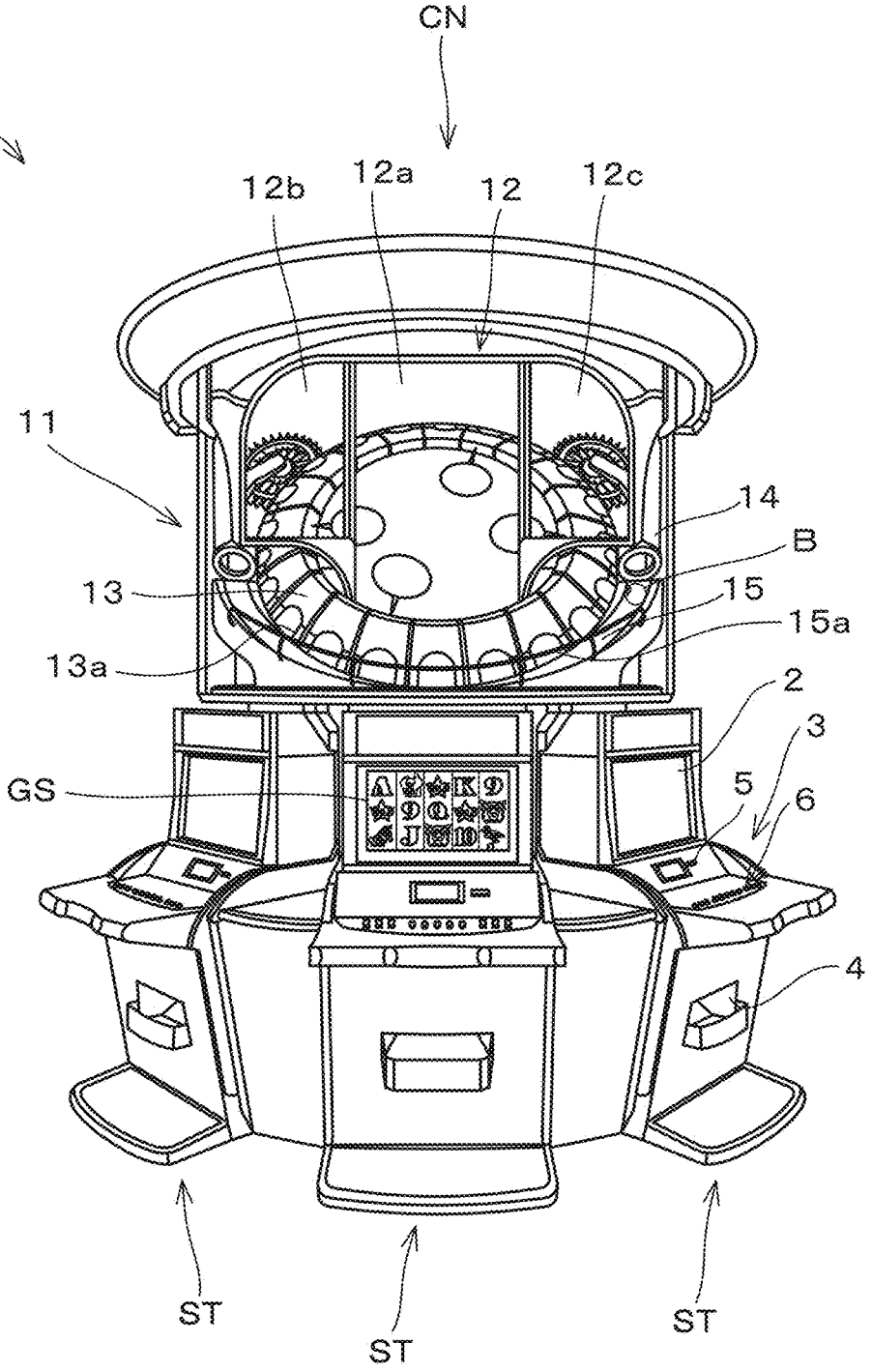
FIG. 1 is an overall view showing a game machine according to an embodiment of the present invention.

FIG. 1 shows an overall view of a game machine according to an embodiment of the present invention. The game machine 1 includes a center unit CN installed in the center of the game machine and a plurality of station units ST disposed around the center unit CN. The number of the station units ST may be changed suitably depending on the store where the game machine is arranged. For instance, three station units ST are installed as shown in FIG. 1, but they may be disposed so as to encircle the center unit CN or one station unit may be installed.

Each station unit ST includes a station monitor 2, a control panel 3, and a coin payout port 4. A game screen GS for executing a slot game is displayed on the station monitor 2. As the station monitor 2, for example, a liquid crystal display device is used. The control panel 3 is installed under the station monitor 2. A coin inserting port 5 for inserting coins and an operation device 6 are installed on the control panel 3. The operation device 6 includes, for example, an operation member such as a button switch for various operations including a betting operation. The coin payout port 4 is installed on the lower side of the control panel 3.

The center unit CN includes a roulette game unit 11 as a physical lottery mechanism, a center monitor 12 and a speaker 13. The roulette game unit 11 is provided with a roulette ring 14 as a lottery board formed with a plurality of pockets 14*a* as a plurality of lots along the circumference potion, a ball throwing mechanism 15 which throws the ball B as a lottery object that can enter each pocket 14*a*, and a ball guidepath 16 on which a ball B is move. The roulette ring 14 is inclined and is rotated about a rotational axis AX by a ring driving mechanism 43 (not shown in FIG. 1) as a driving source. The ring driving mechanism 43 drives the roulette ring 14 to rotate both clockwise and counterclockwise directions. The upper portion of the roulette ring 14 is configured to move the back side of the center monitor 12. Thereby, in the center unit CN, a roulette game board is formed by combination of the lower portion of the roulette ring 14 and an upper image of the roulette ring displayed on the center monitor 12. The ball is put into the ball guidepath 16 by the ball throwing mechanism 15. The ball guidepath 16 is installed along the outer circumference of the roulette ring 14. The ball guidepath 16 is inclined with respect to the roulette ring 14 so that the ball B can easily enter the pocket 14*a*. At least the ball guidepath 16 may be configured to be inclined near the lowest point. By controlling the inclination of the ball guidepath 16, it is possible to adjust the lottery time until the ball enters the pocket 14*a* from throwing in the ball. The ball guidepath 16 is provided with a guide 16*a* which guides the ball B.

The center monitor 12 includes a first monitor 12*a*, and a second monitor 12*b* and a third monitor 12*c* each of which is installed adjacent to both sides of the first monitor 12*a*, and the respective monitors 12*a*, 12*b*, and 12*c* serve as one monitor in combination. The upper image of the roulette ring 14 is displayed on the center monitor 12 corresponding to the movement of the roulette ring 14. It is possible to control the display of the roulette ring 14 on the center monitor 12 by using a ring position detection sensor 44 which detects the position of the roulette ring 14. The ring position detection sensor 44 is installed in such a way that the respective pockets 14*a* of the roulette ring 14 can be identified. For example, it is possible to detect the position of the roulette ring 14 by installing a sensor which detects the rotation amount of the ring driving mechanism 43 for driving the roulette ring 14 or a sensor which detects a predetermined position of the roulette ring 14 as the ring position detection sensor 44. As the ring position detection sensor 44, various types of well-known techniques may be used. For the speaker 13, a well-known speaker unit is applied. The center monitor 12 and the speaker 13 serve as a representation device. Respective wins corresponding to each pocket 14*a* serve as a plurality of options. Incidentally, "loss" may correspond to the pocket 14*a*.

Next, a game played in the game machine 1 will be described. When the player inserts coins into the coin inserting port 5, a video slot game is started on the game screen GS of the station monitor 2. When each rotating reel displayed on the game screen GS is stopped, the lottery results are displayed. Depending on the win being formed, payout is paid to a player through the coin payout port 4. In this case, when a predetermined win is formed, the player can play the roulette game on the center unit CN. When a plurality of station units ST are installed in the game machine 1, a rotation mechanism for rotating the center unit CN may be installed, and the center unit CN may be moved in such a way that the front of the center unit CN faces the station unit ST where a player playing the roulette game is present.

When a roulette game is started, the roulette ring 14 starts to rotate, and the ball B is thrown in the ball guidepath 16 from the ball throwing mechanism 15. As the ball B travels back and forth centering on the lowermost point of the ball guidepath 16, the travel distance decreases slowly. Then, the ball B enters any one pocket 14*a* of a plurality of pockets 14*a* by a relative movement with the roulette ring 14. A ball detection sensor (not shown) which detects the entry of the ball B is installed in each pocket 14*a*. When the ball B is detected, payout corresponding to the pocket 14*a* into which the ball enters is paid to the player through the coin payout port 4. After the ball B is thrown in the ball guidepath 16 from the ball throwing mechanism 15, velocity of the ball B is gradually slow. Here, a range that the ball B having moving velocity capable of entering any one pocket 14*a* of a plurality of pockets 14*a* can move is described as a winning range (an area where the lottery is executed). The ball B can enter to the pocket 14*a* in the winning range. However, the ball B cannot enter to the pocket 14*a* out of the winning range and the roulette game unit 11 has a structure so as not to make the ball B enter in the pocket 14*a* while the ball B keeps the velocity that the ball B can move over the winning range.

Figure 2:
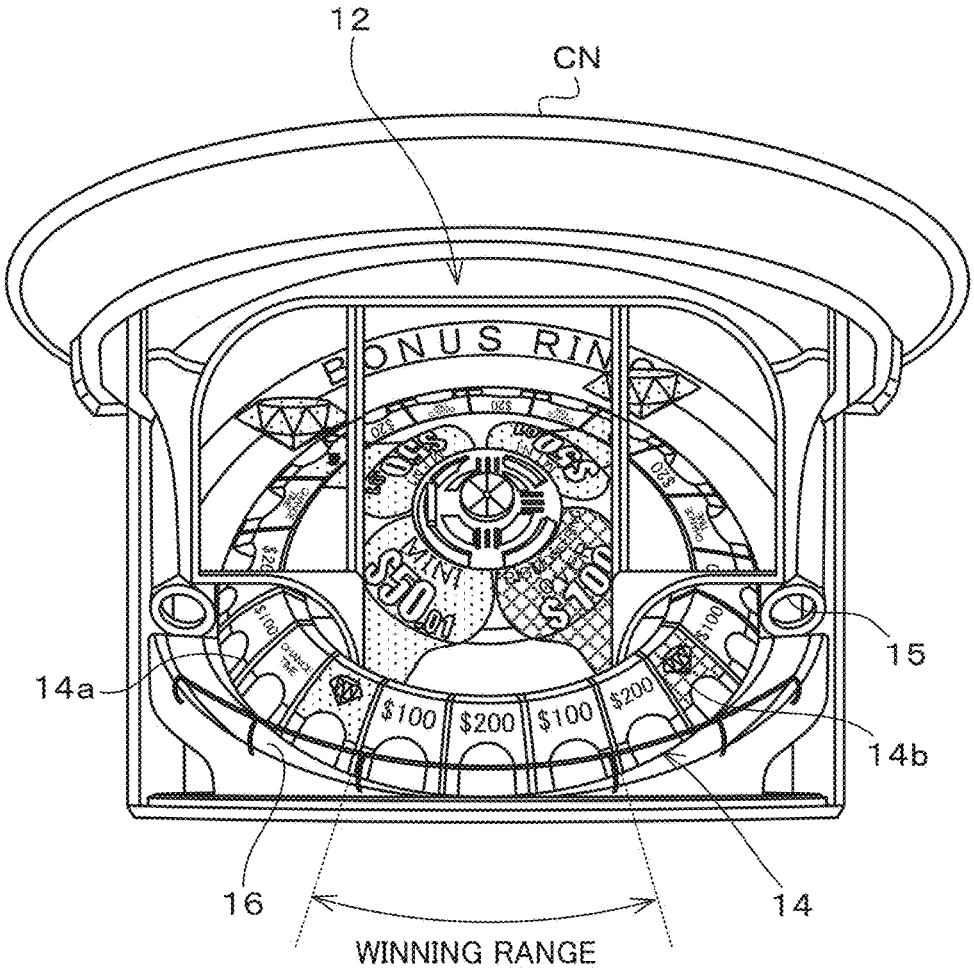
FIG. 2 is a view for describing a boosting effect control function implemented in the game machine.

Referring to FIG. 2, a boosting effect control function implemented in the game machine 1 will be described. When a roulette game is started in the center unit CN and a predetermined temporal condition and a predetermined positional condition are satisfied, a boosting effect processing is executed in the center unit CN. As a temporal condition, a predetermined time (for example, 10 seconds) passing after the start of a roulette game, that is, the ball B is thrown from the ball throwing mechanism 15 is set. To measure time, a timer inside the center control unit 30 may be used, or the rotation amount of the ring driving mechanism 43 may be measured. Any suitable method may be used. As a positional condition, it is set that the pocket 14*a* corresponding to the win from which large payout such as a jackpot is expected (hereinafter also referred to as a JP pocket 14*b*) is located in the winning range. The winning range means a range in which the ball B moving along the ball guidepath 16 can easily enter the pockets 14*a*. That is, the winning range is a range specified by the pockets 14*a* positioned before and after the lowest point of the roulette ring 14 as the center, from the relationship with the ball B. In the example of FIG. 2, three consecutive pockets 14*a* including one of these pockets 14*a* positioned at the lowest point of the roulette ring 14 are set as the winning range. When the roulette ring 14 rotates, the pockets 14*a* positioned in the winning range vary in accordance with the rotation. The JP pocket 14*b* corresponds to the specific lot.

When the JP pocket 14*b* is positioned in the winning range, the positional condition is satisfied. When the temporal condition is also satisfied, a roulette game control portion 34 of the center control unit 30 executes the boosting effect processing. In the boosting effect processing, the roulette game control portion 34 makes the player realize that it has become easy for the ball B to enter the JP pocket 14*b* so as to make boosting effects for the roulette lottery. For instance, a video picture or an image making the player realize that the jackpot winning possibility has risen is displayed on the display center unit 12. Further, the roulette game control portion 34 illuminates the roulette ring 14 with a lamp installed around the roulette ring 14 or issues sound or music through the speaker 13. The boosting effect processing is executed during the period when the positional condition is satisfied, that is, the JP pocket 14*b* is positioned in the winning range.

Figure 3:
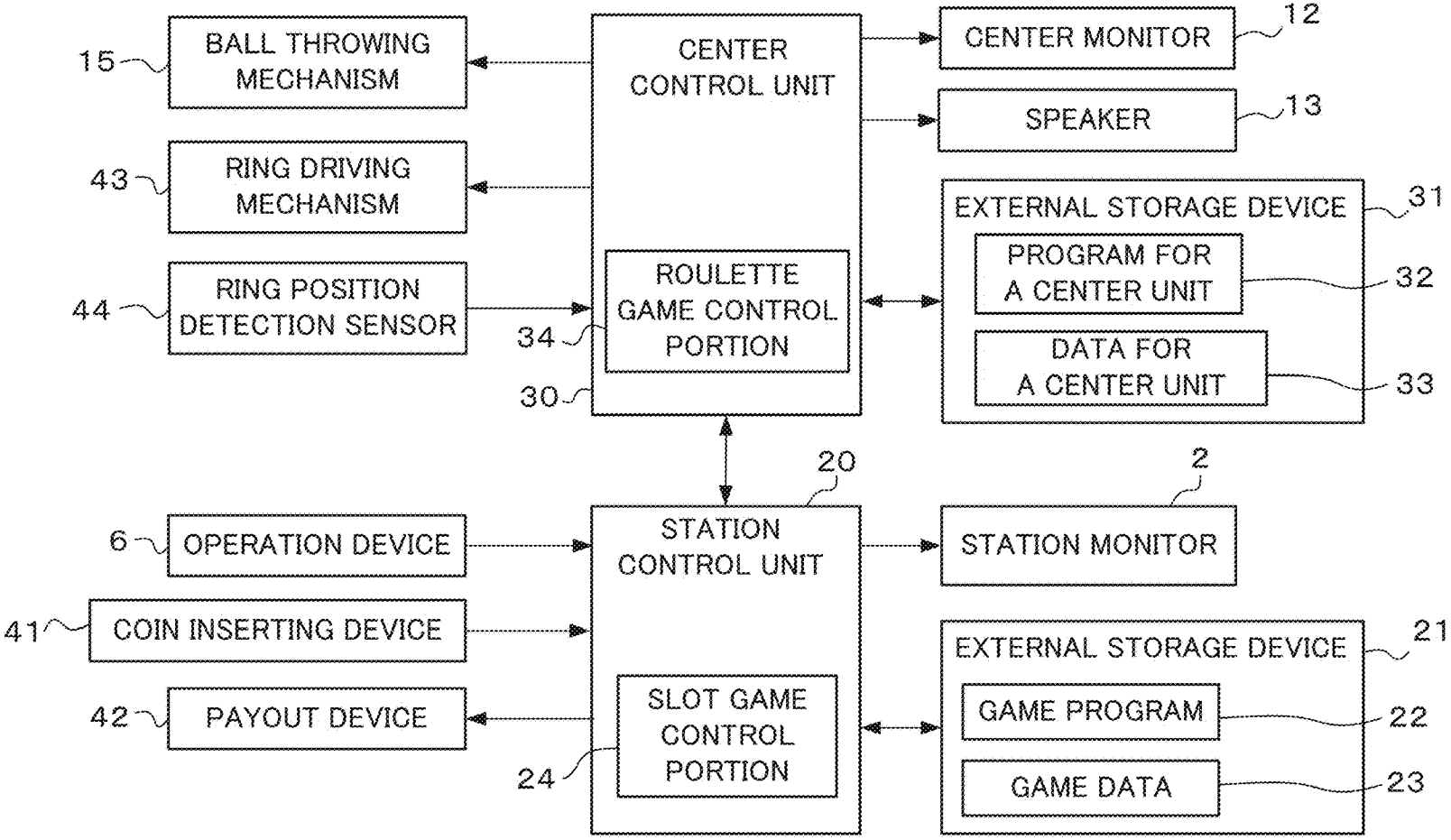
FIG. 3 is a functional block diagram for describing the configuration of a control system of the game machine.

FIG. 3 is a functional block diagram for describing the configuration of the control system of the game machine 1. The game machine 1 is provided with a station control unit 20 and the center control unit 30. Each control unit 20 or 30 is configured as a computer unit in which a micro processor and including a microprocessor, a ROM in which programs such as an operation system to be run by the microprocessor are recorded, and an internal storage device (not shown) such as a RAM that provides the operation area for the microprocessor. External storage devices 21 and 31 are connected to the control units 20 and 30, respectively. The external storage devices 21 and 31 are storage devices capable of storing information such as a nonvolatile semiconductor storage device. The programs for the game machine that are to be run in the control units 20 and 30 and the various data that the programs will refer to are stored in the external storage devices 21 and 31. As an example, a game program 22 and game data 23 are recorded in the external storage device 21 connected to the station control unit 20. Further, a program 32 for the center unit and data 33 for the center unit are recorded in the external storage device 31 connected to the center control unit 30.

Various devices necessary for executing the game played in the game machine 1, such as the operation device 6, the coin inserting device 41 and the payout device 42, are connected to the station control unit 20. The coin inserting device 41 accepts the coins inserted in the coin inserting port 5 as value for playing the game. The coin inserting device 41 issues signals to the station control unit 20 in accordance with the inserting amount (inserting price). The payout device 42 executes payment by coins to the player as payout of the game based on the instruction from the station control unit 20. The coins are paid to the player through the coin payout port 4. Incidentally, the accepting value and the payout for the player are not limited to coins. For instance, medals, tokens or the like may be used as proxy currency. In addition, a payment method in which it is possible to give and take currency values or game values through exchange of electronic information such as electronic currency may be used. In such a case, instead of the coin inserting port 5 and the coin payout port 4, an information communication unit for mutual exchange of electronic information and storage media for storing exchanged information may be used.

The station control unit 20 is provided with a slot game control portion 24. The slot game control portion 24 is a logical device realized by the combination of computer hardware and predetermined software. The slot game control portion 24 executes the processing necessary for controlling the slot game by the station unit ST. As an example, the slot game control portion 24 executes the processes such as changing the display of plural symbols, generating the random numbers of a predetermined digit, lottery of plural symbols using the random number, and determining whether or not the combination of symbols by the lottery forms a predetermined win array. Incidentally, generation of random numbers may be realized by a physical device that combines electronic circuits. Although not shown, other logical devices or physical devices necessary for executing the slot game are installed in the station control unit 20.

Various devices necessary for executing the roulette game, such as the center monitor 12, the speaker 13, the ball inserting mechanism 15, the ring driving mechanism 43, and the ring position sensor 44, are connected to the center control unit 30. The center control unit 30 is provided with the roulette game control portion 34. The roulette game control portion 34 is a logical device realized by the combination of computer hardware and predetermined software. The roulette game control portion 34 executes the processing necessary for controlling the roulette game by the center unit CN. As an example, the roulette game control portion 34 executes various processes for controlling the ball throwing mechanism 15, for controlling the ring driving mechanism 43, and for detecting the position of the roulette ring 14 and controlling the effects of the roulette game based on the detection results.

Figure 4:
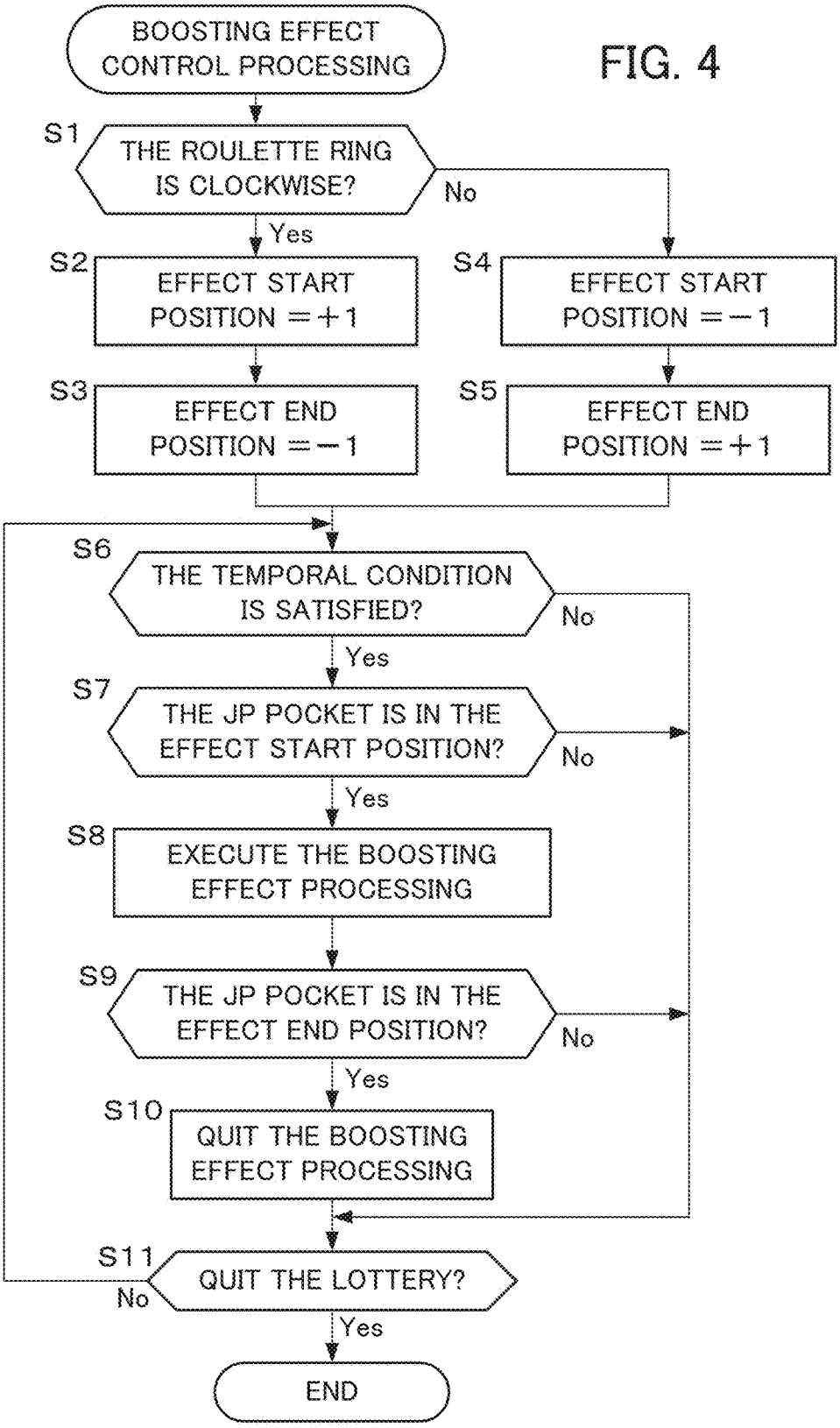
FIG. 4 is a flowchart showing a boosting effect control processing executed by a roulette game control portion of a center unit.
Figure 5:
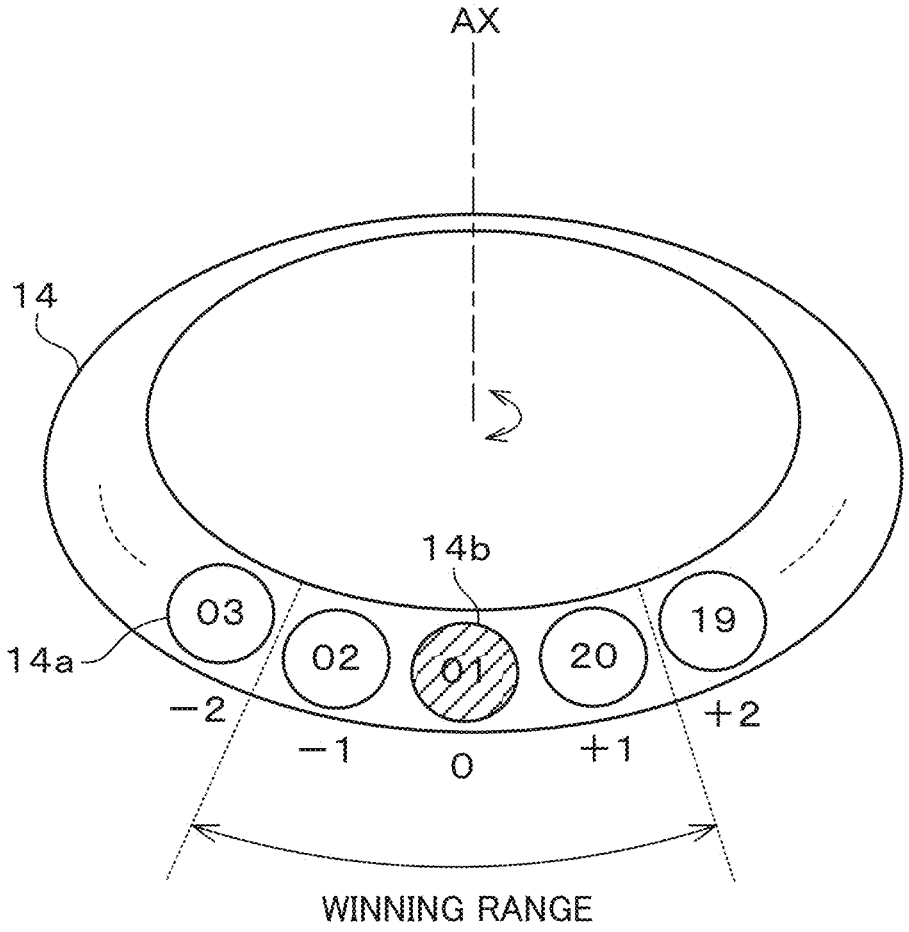
FIG. 5 is a schematic view for describing the positional relationship of pockets of a roulette ring.

FIG. 4 is a flowchart showing the boosting effect control processing executed by the roulette game control portion 34 of the center unit CN. The boosting effect control processing is a processing for executing the boosting effects to make boosting effects for the roulette game after the start of a roulette game. When the roulette game is started, the roulette game control portion 34 determines whether or not the rotation direction of the roulette ring 14 is clockwise (step S1). In determining the rotation direction, well-known techniques may be used. FIG. 5 is a schematic view for describing the positional relationship of pockets 14*a* of the roulette ring 14. Incidentally, FIG. 5 shows only the roulette ring 14, and does not show the center monitor 12. If the rotation of the roulette ring 14 is clockwise, the roulette game control portion 34 sets a position of the JP pocket 14*b* positioned at a position number "+1" as the effect start position (step S2), and sets a position of the JP pocket 14*b* positioned at a position number "−1" as the effect end position (step S3). Here, as the position number, the number "0" is given to the position of the pocket 14*a* that is positioned at the lowest point, and "+1" or "−1" is given to the pocket before or after it. Also, pocket numbers "01", 02", "03", . . . "20" are given to the pockets 14*a*, respectively, for facilitating the explanation. In the example of FIG. 5, the pocket number "01" is the JP pocket 14*b*. In this case, the range from the position number "+1" to the position number "−1" is set as the winning range.

On the other hand, if the rotation of the roulette ring 14 is counterclockwise, the roulette game control portion 34 sets a position of the JP pocket 14*b* positioned at a position number "−1" as the effect start position (step S4), and sets a position of the JP pocket 14*b* positioned at a position number "+1" as the effect end position (step S5). The position of the JP pocket 14*b* is detected by the ring position detection sensor 44.

Figure 6:
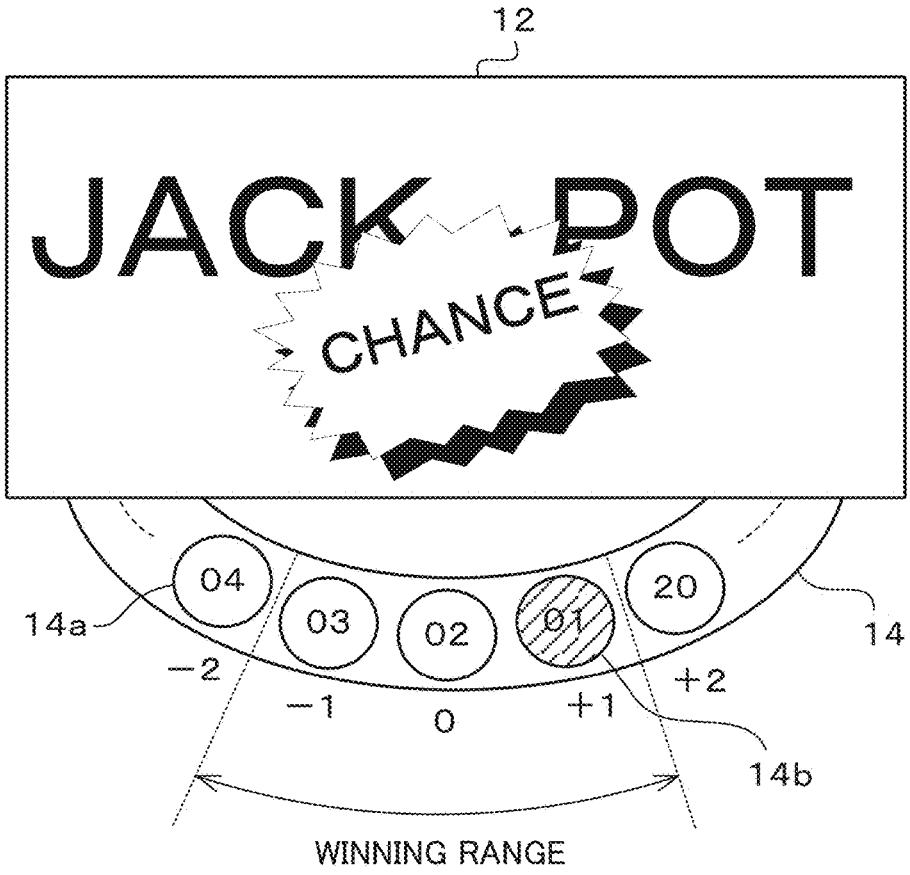
FIG. 6 is a schematic view showing an example of boosting effects.

Next, the roulette game control portion 34 determines whether or not the temporal condition is satisfied (step S6). The roulette game control portion 34 determines whether or not 10 seconds have elapsed when a lapse of 10 seconds, for example, is set from the throwing of the ball B from the ball throwing mechanism 15 as the temporal condition. The setting of time for the temporal condition may be changed suitably. When the temporal condition is satisfied, the roulette game control portion 34 determines whether or not the JP pocket 14*b* is positioned at the effect start position (step S7). If the rotation of the roulette ring 14 is clockwise, the roulette game control portion 34 executes the boosting effect processing when the JP pocket 14*b* reaches the effect start position, that is, the position number "+1", and thus the positional condition is satisfied (step S8). FIG. 6 is a schematic view showing an example of the boosting effects. If the temporal condition is satisfied, the movement range of the ball B is narrowed, so the ball B comes to be moved within the winning range. If the JP pocket 14*b* is positioned within the winning range, the positional condition is satisfied, so the possibility of the ball B entering the JP pocket 14*b* becomes high. That is, the positional condition is satisfied when the positional relationship becomes one in which the JP pocket 14*b* and the ball B are within the winning range. Therefore, as in the example of FIG. 6, the roulette game gets a boost by making the boosting effects on the center monitor 12 to attract the player's attention, and it is possible to enhance the excitement of the game. The boosting effects for the roulette game may be done by outputting sound or music through the speaker 13, it is not limited to the center monitor 12. Incidentally, as the boosting effects, plural kinds of images, videos, sounds or music may be prepared.

Further, the roulette game control portion 34 determines whether or not the JP pocket 14*b* is positioned at the effect end position (step S9). If the rotation of the roulette ring 14 is clockwise, the roulette game control portion 34 quits the boosting effect processing when the JP pocket 14*b* arrives at the effect end position, that is, the position of the position number "−1" (step S10). Then, the roulette game controller 34 determines whether or not the roulette game has ended, that is, determines which of pockets 14*a* the ball B entered (step S11). If the roulette game has not ended yet, the roulette game control portion 34 returns to the step S6 and repeats the processing thereafter. Meanwhile, if negative determination is determined in these steps S6, S7, and S9, the roulette game control portion 34 determines whether or not the roulette game has ended (step S11), and if the roulette game has not ended yet, the processing returns to the step S6. Meanwhile, if the roulette game is ended, the roulette game control portion 34 quits the processing of this round. When roulette lottery is ended, the roulette game control portion 34 makes the player realize that a win corresponding to the pocket 14*a* into which the ball B has entered has come into existence and gives payout to the player.

In the processing described above, when the center unit CN starts a roulette game, the effect start position and the effect end position are set according to the rotation direction of the roulette ring 14 (steps S1 to S5). When the temporal condition is satisfied (step S6) and the positional condition is satisfied (steps S7 and S9), the boosting effect processing is executed (step S8). This boosting effect processing has a high possibility that the ball B is in the winning range, and is executed only while the JP pocket 14*b* is included in the winning range, that is, only while the ball B and the JP pocket 14*b* are nearby. Therefore, only when the possibility of hitting a jackpot is high, it can capture the player's attention, and the expectation for the player to win a jackpot can be raised. In the processing described above, the roulette game control portion 34 serves as an effect control device by executing the processing of these steps S6 to S10.

The present invention is not limited to the above embodiment and can be implemented in various forms. For example, in the present embodiment, the jackpot is described as the win for making the boosting effect, but it is not limited to this. The boosting effects for the win other than the jackpot may be made. The boosting effects for plural kinds of wins may be made. The kind of effects may be changed according to the win. Further, in the present embodiment, a physical lottery mechanism is described as a lottery mechanism executed in the center unit CN, but it is not limited to this. In the electronic lottery mechanism, the boosting effects may be executed. The present invention can be also applied to an electronic lottery mechanism, if the lottery mechanism which holds the lottery at least one option from a plurality of options is executed on a monitor, for example, by executing the physical engine and displaying the relative movement of the lottery board having a plurality of lots corresponding to a plurality of options and the lottery object, respectively. The temporal condition may be set as the lapse of a predetermined time from the time at which the lottery object (the ball as an example) is put into the lottery board (the roulette board as an example), and the positional condition may be set as the winning range as in the roulette game unit 11. If each movable conical roulette board which is formed in a recessed shape in the center with a plurality of movable options respectively is displayed on a monitor, for example, the winning range is set near the center where the movement of the throwing ball converges, and the positional condition is satisfied when the option of the win is positioned within the winning range. The specification of the winning range may be set suitably according to the shape of the lottery board. Further, it is possible to suitably change both the physical lottery mechanism and the electronic lottery mechanism.

The above embodiment has been described with the winning range centered on the lowest point of the roulette ring 14, but it is not limited to this. For instance, the winning range may be specified with a positional relationship between the lottery object and the specific lot. For instance, in the case of a roulette board for which the rotation direction is set in the horizontal direction, a predetermined range centering on the specific lot is made a winning range, and when the lottery object enters the winning range, the positional condition is satisfied. A detection sensor for detecting that the lottery object has entered the winning range may be installed on the roulette board. In this case, the winning range is moved together with the specific lot. Incidentally, well-known techniques may be used for the detection device.

The above embodiment describes the timer installed inside the center control unit 30 for measuring the lapse of the predetermined time of the temporal condition, but it is not limited to this. For instance, the velocity below a predetermined velocity by detecting the velocity of the ball B may be set as the temporal condition. In this case, a velocity sensor for detecting the velocity of the ball B may be installed on the ball guidepath 16 near the lowest point of the roulette ring 14 of the center unit CN as a velocity detection device. If the ball B loses velocity, the ball B moves in the winning range toward the center. Thus, a suitable velocity is set, and the temporal condition may be satisfied if the velocity becomes below the set velocity. Further, a rotation amount detection device that detects the rotation amount of the roulette ring 14 may be installed in the ring driving mechanism 43. In this case, the number of rotations or the angle of rotation of the roulette ring 14 may be used as the rotation amount.

What is claimed is:

1. A game machine including;

a lottery mechanism which holds a lottery to select at least one option from a plurality of options by a relative movement between a lottery board having a plurality of lots corresponding respectively to the plurality of options and a lottery object, the lottery board including a specific lot corresponding to a specific option among the plurality of options, wherein the lottery object is movable along a guidepath positioned adjacent to the lottery board, the lottery mechanism configured to initiate the lottery by rotating the lottery board;

an effect device which makes predetermined effects to the lottery in the lottery mechanism and an effect control device configured to:

determine a position of the specific lot with respect to the guidepath; and, while the lottery object is moving along the guidepath, control the effect device so as to make the effects upon detecting occurrence of a temporal condition and a positional condition under which the specific lot corresponding to the specific option among the plurality of options and the lottery object are in a predetermined positional relationship are satisfied.

2. The game machine of claim 1, wherein the effect control device makes the effect device execute the effects which make a player realize a situation that the specific option becomes easy to be selected by the lottery when the temporal condition and the positional condition are satisfied.

3. The game machine of claim 1, wherein the lottery mechanism is a physical lottery mechanism.

4. The game machine of claim 3, comprising a driving source which makes the lottery board rotate about a rotation axis, wherein the plurality of lots are arranged along a circumferential portion of the lottery board.

5. The game machine of claim 3, further comprising a velocity detection device which detects a velocity of the lottery object, wherein as the temporal condition, the velocity of the lottery object is set to be less than a predetermined velocity.

6. The game machine of claim 4, further comprising a rotation amount detection device which detects a rotation amount of the lottery board, wherein as the temporal condition, the rotation amount of the lottery board is set to be more than a predetermined rotation amount.

7. The game machine of claim 1, further comprising a timer which measures a time, wherein as the temporal condition, the measured time is set to be more than a predetermined time.

8. A game machine as set forth in claim 1, wherein the temporal condition includes at least one of a lapse of a predetermined time after the lottery is started and a velocity of the lottery object is less than a predetermined velocity.

9. A game machine including:

a lottery mechanism which holds a lottery to select at least one option from a plurality of options by a relative movement between a lottery board having a plurality of lots corresponding respectively to the plurality of options and a lottery object;

an effect device which makes predetermined effects to the lottery in the lottery mechanism;

an effect control device which controls the effect device so as to make the effects when a temporal condition and a positional condition under which a specific lot corresponding to a specific option among the plurality of options and the lottery object are in a predetermined positional relationship are satisfied, wherein the lottery mechanism is a physical lottery mechanism;

a driving source which makes the lottery board rotate about a rotation axis, wherein the plurality of lots are arranged along a circumferential portion of the lottery board, wherein the lottery board is inclined and is configured in such a way that the lottery object enters the lot near the lowest point of the lottery board, and as the positional condition, the specific lot is included in a winning range centering on the lowest point of the lottery board.

10. A game control method of a game machine, the gaming machine including a lottery mechanism and an effect device, the lottery mechanism holds a lottery to select at least one option from a plurality of options by a relative movement between a lottery board having a plurality of lots corresponding respectively to the plurality of options and a lottery object, the lottery board including a specific lot corresponding to the specific option among the plurality of options, wherein the lottery object is movable along a guidepath positioned adjacent to the lottery board the effect device makes predetermined effects to the lottery in the lottery mechanism, the method including the steps of;

an initiating step, by the lottery mechanism, of initiating the lottery by rotating the lottery board;

a step of determining a position of the specific lot with respect to the guidepath; and, while the lottery object is moving along the guidepath, an effect control step which controls the effect device so as to make the effects upon detection of a temporal condition and a positional condition under which a specific lot corresponding to the specific option among the plurality of options and the lottery object are in a predetermined positional relationship are satisfied.

11. A game control method as set forth in claim 10, wherein the temporal condition includes at least one of a lapse of a predetermined time after the lottery is started and a velocity of the lottery object is less than a predetermined velocity.

12. A computer program for a game machine, the game machine including a lottery mechanism which holds a lottery to select at least one option from a plurality of options by a relative movement between a lottery board having a plurality of lots corresponding respectively to the plurality of options and a lottery object, the lottery board including a specific lot corresponding to a specific option among the plurality of options, wherein the lottery object is movable along a guidepath positioned adjacent to the lottery board, the computer program is constructed so as to the computer set in the game machine to serve as:

an effect device which makes predetermined effects to the lottery in the lottery mechanism; and, an effect control device configured to:

determine a position of the specific lot with respect to the guidepath; and, while the lottery object is moving along the guidepath, control the effect device so as to make the effects upon detecting occurrence of a temporal condition and a positional condition under which the specific lot corresponding to the specific option among the plurality of options and the lottery object are in a predetermined positional relationship are satisfied.

13. A computer program for a game machine as set forth in claim 12, wherein the temporal condition includes at least one of a lapse of a predetermined time after the lottery is started and a velocity of the lottery object is less than a predetermined velocity.

14. A game control method of a game machine, the game machine including a lottery mechanism and an effect device, the lottery mechanism holds a lottery to select at least one option from a plurality of options by a relative movement between a lottery board having a plurality of lots corresponding respectively to the plurality of options and a lottery object, the effect device makes predetermined effects to a lottery in the lottery mechanism, the game control method includes:

an effect control step which controls the effect device so as to make the effects when a temporal condition and a positional condition under which a specific lot corresponding to the specific option among the plurality of options and the lottery object are in a predetermined positional relationship are satisfied wherein the lottery mechanism is a physical lottery mechanism; and a rotation step of rotating the lottery board about a rotation axis by a driving source, wherein the plurality of lots are arranged along a circumferential portion of the lottery board, wherein the lottery board is inclined and is configured in such a way that the lottery object enters the lot near the lowest point of the lottery board, and as the positional condition, the specific lot is included in a winning range centering on the lowest point of the lottery board.

* * * * *